US006139270A

United States Patent [19]

Liao

[11] Patent Number: 6,139,270

[45] Date of Patent: Oct. 31, 2000

[54] ELECTRIC FAN

[76] Inventor: Chin-I Liao, 1st Fl., No. 10, Te-Femd St., Chung-Ho Li, Hsin-Chuang City, Taipei Hsien, Taiwan

[21] Appl. No.: 09/256,924

[22] Filed: Feb. 24, 1999

[51] Int. Cl.[7] ..... F24F 7/00

[52] U.S. Cl. ..... 416/142; 416/146 R; 416/247 R; 416/244 R

[58] Field of Search ..... 416/146 R, 142, 416/246, 244 R, 247 R; 422/122, 123, 124

[56] References Cited

U.S. PATENT DOCUMENTS 2,100,923 11/1937 Schmidt et al. ..... 416/246

4,341,151 7/1982 Sakamoto ..... 416/247 R 5,281,103 1/1994 Lin ..... 416/142

*Primary Examiner*—Edward K. Look

*Assistant Examiner*—Richard Woo

*Attorney, Agent, or Firm*—Jackson Walker

[57] ABSTRACT

The present invention relates an electric fan. The fan has a body and a fan assembly housed in the body. The fan is able to pivot and elevate/descend with respect to the body. Furthermore, the body has a fragrance container received in a recess defined in the body, such that when the fan is activated, ambience will be full of delightful scent.

8 Claims, 7 Drawing Sheets

ELECTRIC FAN

BACKGROUND OF THE INVENTION

1. Field of the Invention

The present invention relates to an electric fan, and more particularly to an electric fan, which can be used in an upright position and a horizontal position by means of the elevation and decent of a pair of racks attached to the rear grill of the fan.

2. Description of Related Art

An electric fan normally can only be used in either an upright position or a horizontal position. That is, the configuration of the fan limits how a user will be able to use the electric fan. The appearance of the conventional electric fan is also dull, such that it adds no ambiance to its surroundings.

To overcome the drawbacks, the invention intends to provide an improved electric fan, which can be used in either an upright or a horizontal position. Furthermore, a container having fragrance stored therein is provided with the electric fan so that when the fan is actuated, the surroundings will have a delightful scent.

An electric fan constructed in accordance with the present invention tends to mitigate and/or obviate the aforementioned problem.

SUMMARY OF THE INVENTION

The main object of the present invention is to provide an improved electric fan, which can be used in either an upright or a horizontal position.

Another object of the present invention is to provide a container as part of the electric fan having fragrance stored therein, such that the surroundings will have a delightful scent after the electric fan is started.

Other objects, advantages and novel features of the invention will become more apparent from the following detailed description when taken in conjunction with the accompanying drawings.

BRIEF DFSCRIPTION OF THE DRAWINGS

DETAILED DESCRIPTION OF THE PREFERRED EMBODIMENT

Figure 1:
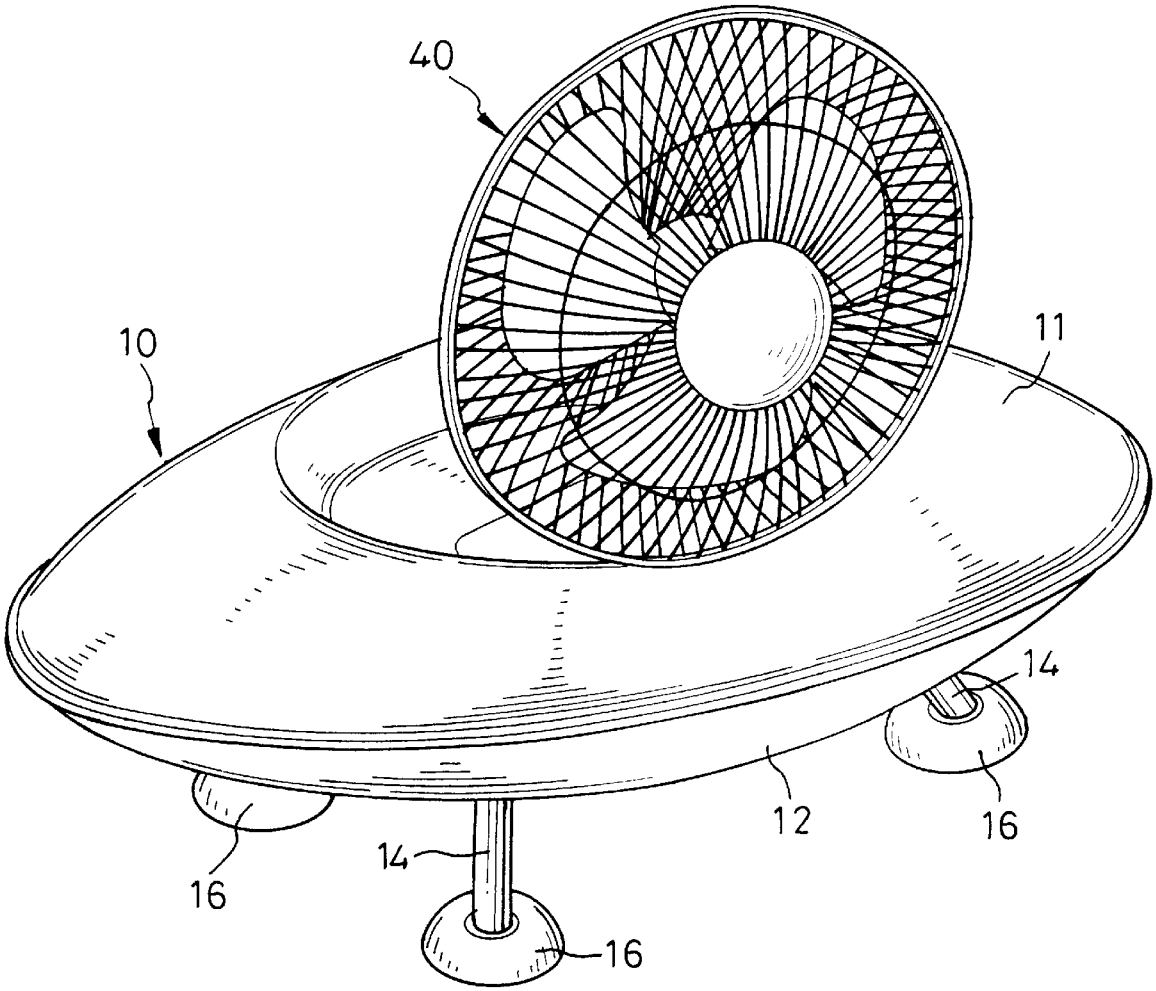
FIG. 1 is a perspective view showing the electric fan of the present invention.
Figure 2:
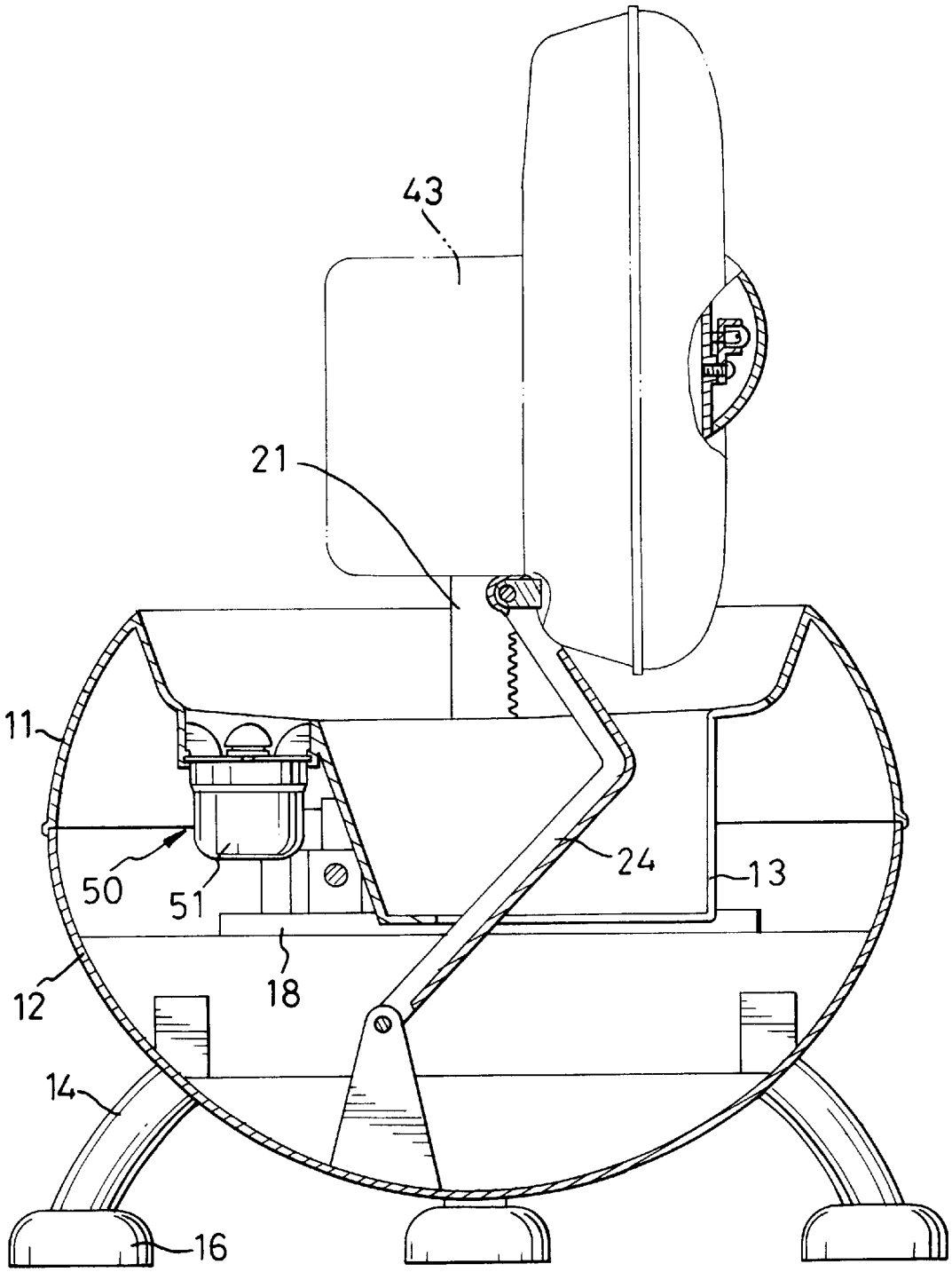
FIG. 2 is a schematic view showing the inner structure of the body of the electric fan.
Figure 3:
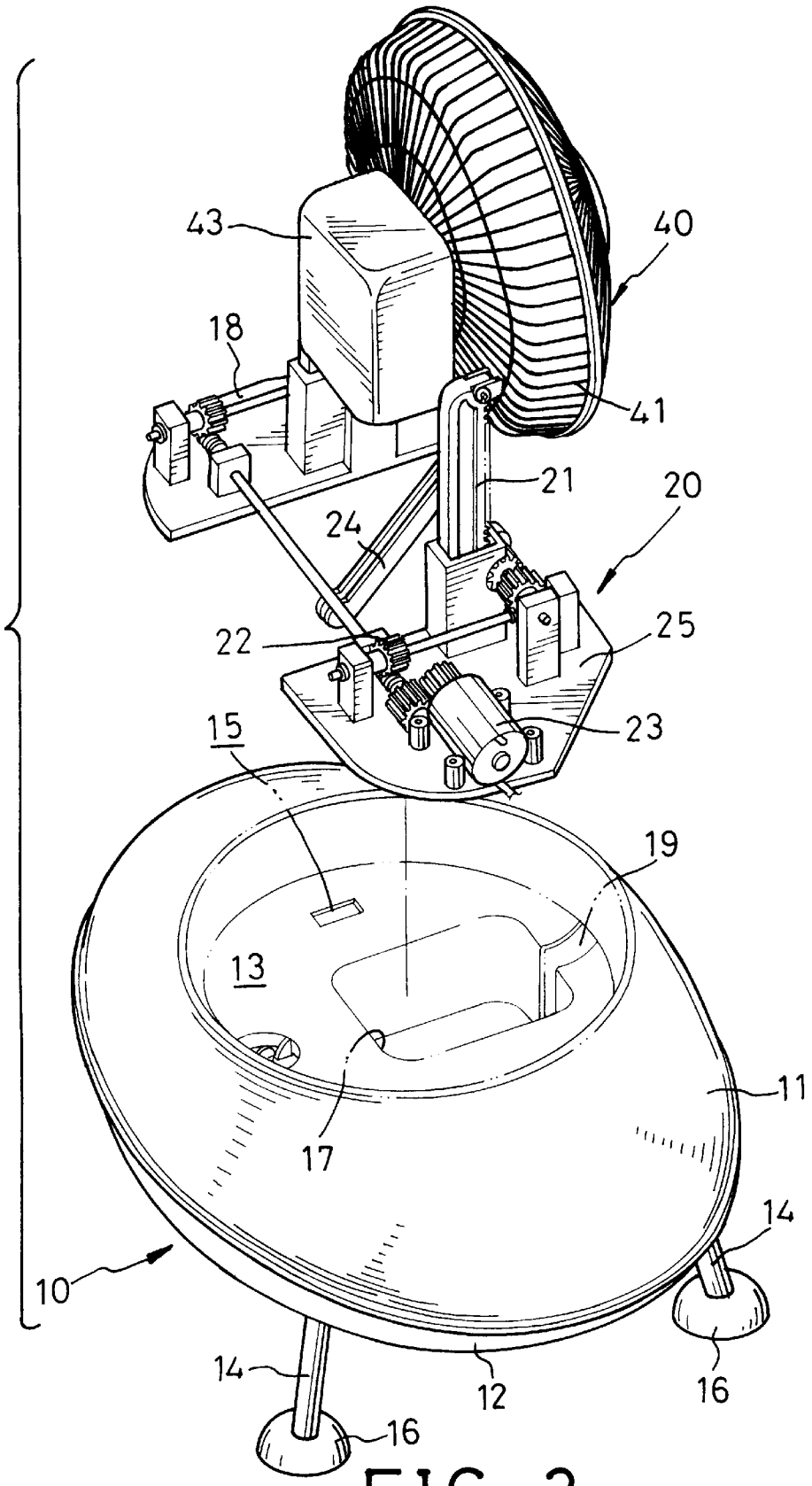
FIG. 3 is an exploded perspective view showing a fan connected to a transmission member and the body before assembly.

Referring to FIG. 1, 2, 3 and 4, an electric fan constructed in accordance with the invention comprises a fan (40) having a grill (41) provided with a pair of opposed lugs (42) on the rear face thereof and a case (43) securely connected to the fan (40).

A body (10) houses a transmission member (20) therein and has a cover (11) with a recess (13) defined therein for receiving the grill (41) of the fan (40) therein, a pair of openings (15) defined in a face defining the recess (13) so as to respectively correspond to each of the racks (21), such that each of the racks (21) are able to extend from the corresponding openings (15), a trough (17) defined in the face defining the recess (13) and communicated with the recess (13) for receiving the case (43) of the fan (40) therein and a path (19) communicating with the trough (17) and the recess (13) for selectively receiving the L-shaped link (24) therein and a bottom (12) detachably connected with the cover (11) and provided with a plurality of spaced legs (14) securely extended outward for supporting the body (10) and each of the legs (12) having a foot (16) formed on a distal end thereof.

Figure 4:
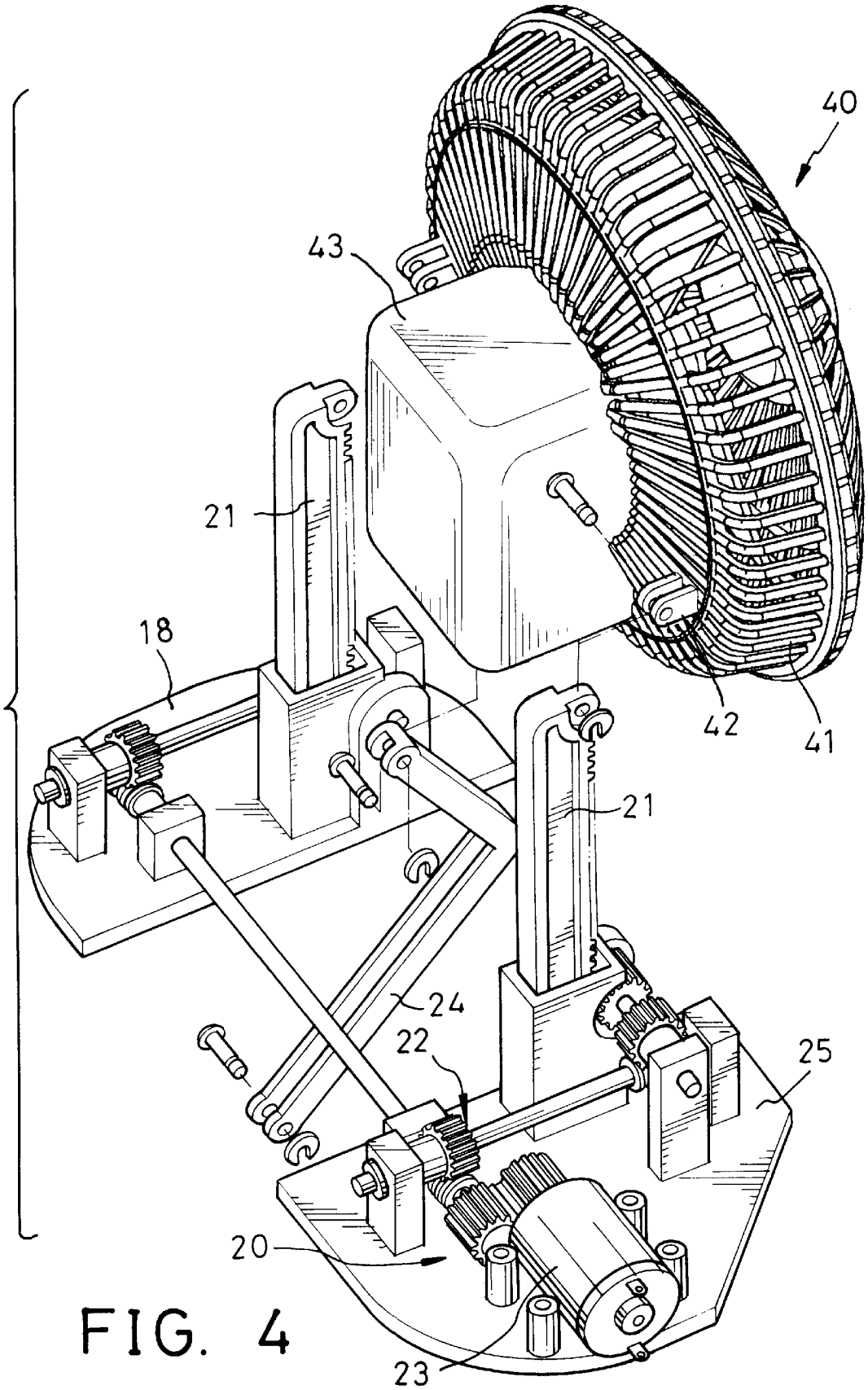
FIG. 4 is an exploded perspective view showing the fan and the transmission member of the fan assembly.

Referring to FIG. 4, the transmission member (20) has a pair of racks (21) movably mounted thereon and respectively corresponded to and pivotally connected with one of the lugs (42), a gear set (22) securely connected with each of the racks (21), a motor (23) securely connected with the gear set (22) for controlling the movement of the racks (21); a pair of bases (25, 18) respectively supporting the racks (21) and the gear set (22) thereon and an L-shaped link (24) pivotally connected between the underside of the case (43) and the inner face of the body (10).

Figure 5:
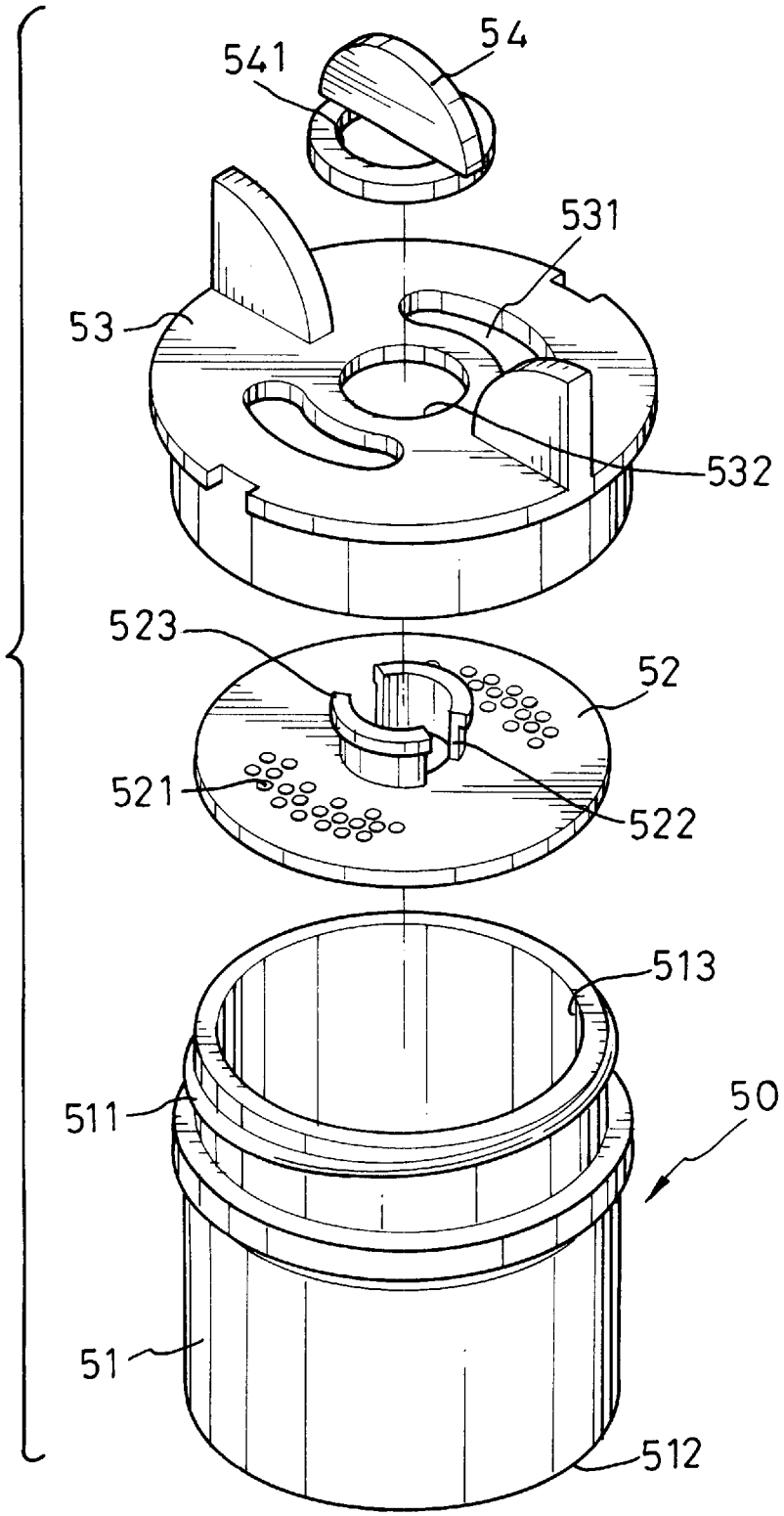
FIG. 5 is an exploded perspective view showing fragrance container provided to the electric fan of the invention.

Furthermore, referring to FIG. 5, a container (50) for storing a fragrant substance (not shown) is provided in the recess (13) of the body (10). The container (50) has a cylindrical body (51) provided with a closed end (512), an open end (513) with outer threads (511), a cover (52) securely located on top of the cylindrical body (51) to close the open end (513) and having two sets of holes (521) defined in opposite sides thereof and a split bushing (522) formed thereon and having a flange (523) provided on the top edge thereof, an outer cover (53) threadingly connected with the outer threads (511) to enclose the cover (52) and having two arcuate slots (531) defined to respectively and selectively corresponding to each set of the holes (521) and a central hole (532) defined to correspond to the split bushing (522) so as to allow the split bushing (522) to extend therefrom and a button (54) having two opposed openings (541) respectively corresponding to one of the two segments of the split bushing (522), thereby allowing the flanges (523) of the split bushing (522) to securely abut the peripheral face defining the openings (541).

Figure 6:
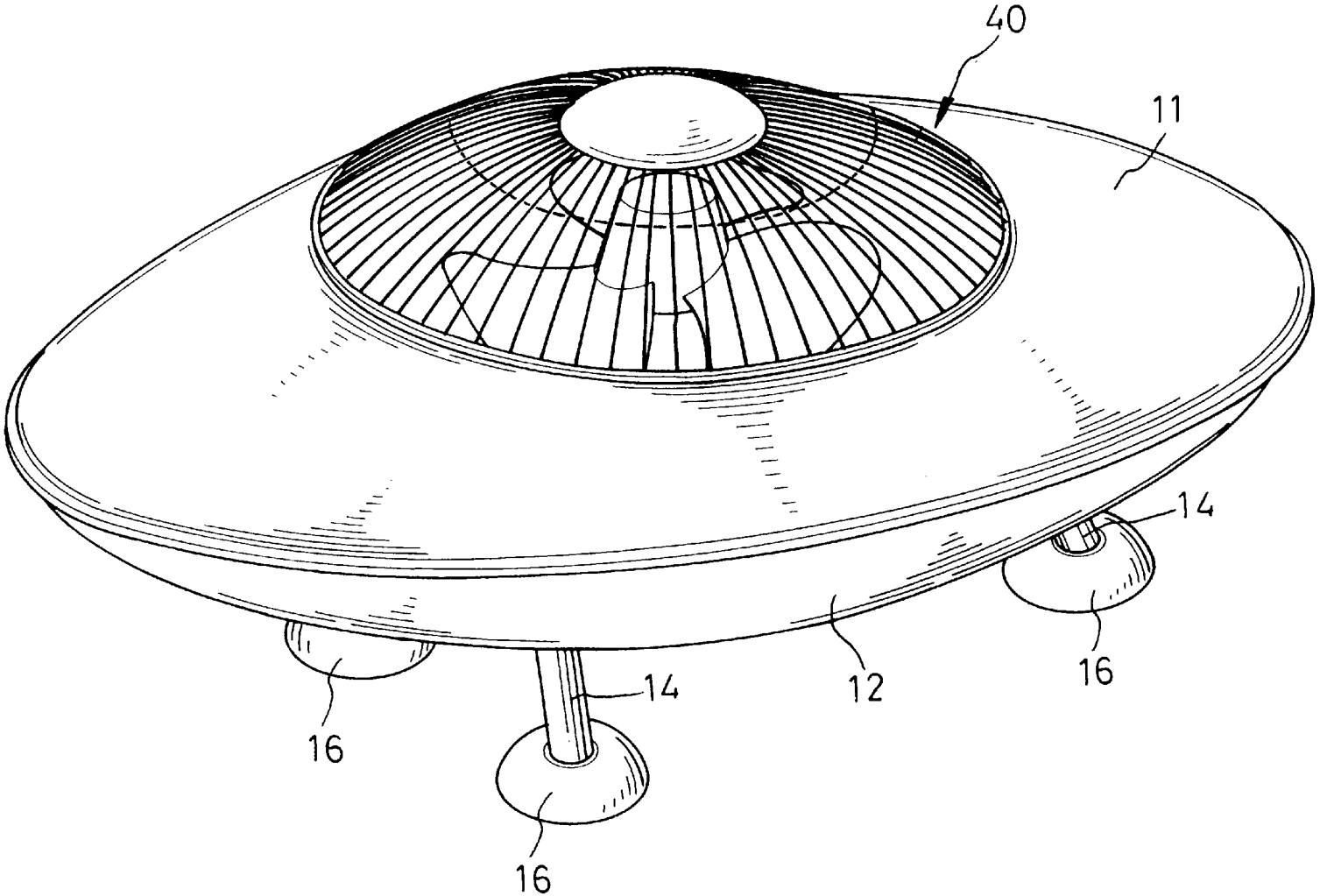
FIG. 6 is a perspective view showing the electric fan in accordance with the present invention used in a different status.
Figure 7:
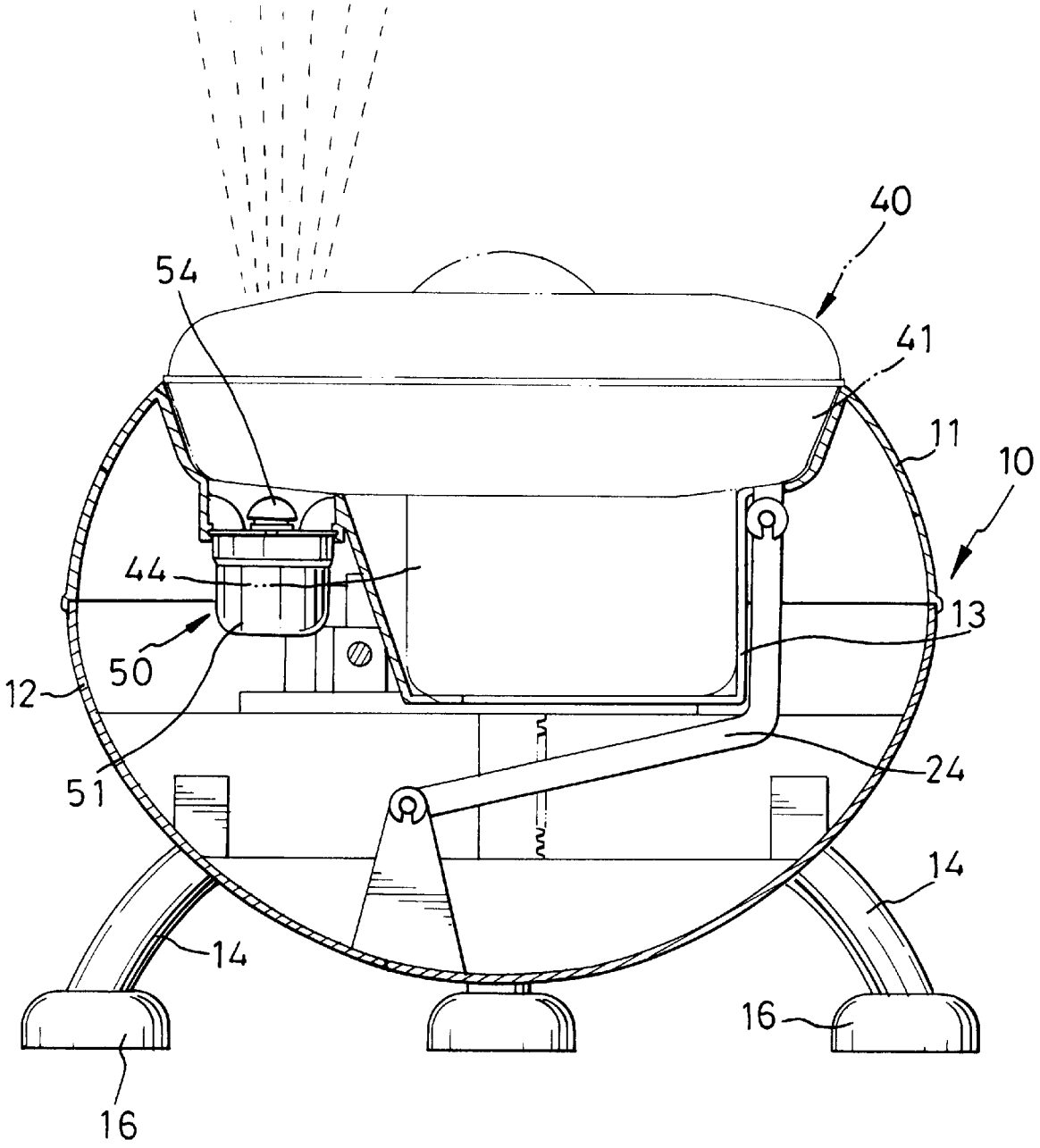
FIG. 7 is a schematic view showing the status of the electric fan shown in FIG. 6.

With such an arrangement, when the motor (23) is activated, the racks (21) will be able to elevate or descend depending on the requirement or desire of the user. Furthermore, when the racks (21) are lowered by the traction of the gear set (22), due to the pivotal connection of the L-shaped link (24) between the underside of the case (43) and the inner face of the body (10), the L-shaped link (24) is received in the path (19). Once the L-shaped link (24) is received in the path (19) and, of course, the case (43) is received in the recess (13), the fan (40) is oriented in such a direction that the grill (41) of the fan (40) together with the cover (11) integrally form a smooth and arcuate face, as shown in FIGS. 6 and 7.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric fan comprising:

a fan (40) having a grill (41) provided with a pair of opposed lugs (42) on the rear face thereof;

a case (43) securely connected to the fan (40);

a transmission member (20) having a pair of racks (21) movably mounted thereon and respectively corresponding to and pivotally connected with one of the lugs (42), a gear set (22) securely connected with each of the racks (21), a motor (23) securely connected with the gear set (22) for controlling the movement of the racks (21); and a pair of bases (25,18) respectively supporting the racks (21), the gear set (22), the motor (23) thereon; and a body (10) having the transmission member (20) securely received therein and provided with a cover (11) with a recess (13) defined therein for receiving the grill (41) of the fan (40) therein, a pair of openings (15) defined in the face defining the recess (13) respectively corresponding to each of the racks (21) so as to allow the racks (21) to extend therefrom and a trough (17) defined in the face defining the recess (13) and communicating with the recess (13) for receiving the case (43) of the fan (40) therein.

2. The fan as claimed in claim 1, wherein a path (19) communicating with the trough (17) and the recess (13) is defined.

3. The fan as claimed in claim 2 further comprising an L-shaped link (24) pivotally connected between the underside of the case (43) and an inner face of the body (10), wherein the L-shaped link (24) is selectively received in the path (19).

4. The fan as claimed in claim 1, wherein a container (50) having a fragrant substance stored therein is provided in the recess (13).

5. The fan as claimed in claim 3, wherein the body has a plurality of spaced legs securely extended outward for supporting the body (10).

6. The fan as claimed in claim 5, wherein each one of the legs (14) has a foot (16) formed on the distal end thereof.

7. The fan as claimed in claim 4, wherein the container has a cylindrical body (51) provided with a closed end (512), an open end (513) and outer threads (511), a cover (52) securely located on top of the cylindrical bottom (51) to close the open end (513) and having two sets of holes (521) defined in opposite sides thereof and a split bushing (522) formed thereon having a flange (523) provided on the top edge thereof, an outer cover (53) threadingly connected with the outer threads (511) to enclose the cover (52) and having two arcuate slots (531) defined to respectively and selectively corresponding to each set of the holes (521) and a central hole (532) defined to correspond to the split bushing (522) so as to allow the split bushing (522) to extend therefrom and a button (54) having two opposed openings (541) respectively corresponding to one of the split bushing (522) parts, thereby allowing the flanges (523) of the split bushing (522) to securely abut the peripheral face defining the openings (541).

8. An electric fan comprising:

a fan (40) having a grill (41) provided with a pair of opposed lugs (42) on the rear face thereof;

a case (43) securely connected to the fan (40);

a transmission member (20) having a pair of racks (21) movably mounted thereon and respectively corresponding to and pivotally connected with one of the lugs (42), a gear set (22) securely connected with each of the racks (21), a motor (23) securely connected with the gear set (22) for controlling the moving of the racks (21); a pair of bases (25,18) respectively supporting the racks (21), the gear set (22), the motor (23) thereon and an L-shaped link (24) pivotally connected between the underside of the case (43) and the inner face of a body (10);

the body (10) having the transmission member (20) securely received therein and provided with a cover (11) with a recess (13) defined therein for receiving the grill (41) of the fan (40) therein, a pair of openings (15) defined in the face defining the recess (13) respectively corresponding to each of the racks (21) so as to allow the racks (21) to extend therefrom, a trough (17) defined in the face defining the recess (13) and communicating with the recess (13) for receiving the case (43) of the fan (40) therein and a path (19) communicating with the trough (17) and the recess (13) for selectively receiving the L-shaped link (24) therein and a bottom (12) provided with a plurality of spaced legs (14) securely extended outward for supporting the body (10) each having a foot (14) formed on the distal end thereof; and a container (50) received in the recess (13) of the body (10) and having a cylindrical body (51) with a closed end (512), an open end (513) and outer threads (511), a cover (52) securely located on top of the cylindrical body (51) to close the open end (513) and having two sets of holes (521) defined in opposite sides thereof and a split bushing (522) formed thereon and having a flange (523) provided on the top edge thereof, an outer cover (53) threadingly connected with the outer threads (511) to enclose the cover (52) and having two arcuate slots (531) defined to respectively and selectively corresponding to each set of holes (521) and a central hole (532) defined to correspond to the split bushing (522) so as to allow the split bushing (522) to extend therefrom and a button (54) having two opposed openings (541) respectively corresponding to one section of the split bushing (522), thereby allowing the flanges (523) of the split bushing (522) to securely abut the peripheral face defining the openings (541).

* * * * *